252-95 AU 166 EX
9/4/79 X 4,166,794

United States Patent [19]
Grey

[11] 4,166,794
[45] Sep. 4, 1979

[54] LIQUID BLEACH-SOFTENER COMPOSITIONS

[75] Inventor: Seymour Grey, Somerset, N.J.

[73] Assignee: Colgate-Palmolive Company, New York, N.Y.

[21] Appl. No.: 909,592

[22] Filed: May 25, 1978

[51] Int. Cl.[2] ..... D06M 13/36
[52] U.S. Cl. ..... 252/8.8; 252/8.6; 252/95; 252/102
[58] Field of Search ..... 252/8.8, 8.6, 95, 102

[56] References Cited

U.S. PATENT DOCUMENTS

| | | | |
|---|---|---|---|
| 3,163,606 | 12/1964 | Viveen et al. | 252/102 |
| 3,749,674 | 7/1973 | Jones et al. | 252/95 |
| 3,945,936 | 3/1976 | Lucas et al. | 252/102 |
| 4,045,358 | 8/1977 | Romachandran | 252/8.6 |

*Primary Examiner*—William E. Schulz
*Attorney, Agent, or Firm*—Norman Blumenkopf; Herbert S. Sylvester; Murray M. Grill

[57] ABSTRACT

A liquid, bleach softener composition for use in one or more of the wash, rinse and tumble dry cycles of a laundering process comprising a water soluble peroxy bleaching agent, at least 50% thereof being hydrogen peroxide, and a water soluble cationic nitrogen softener compound, at least 50% thereof being an aliphatic, quaternary ammonium compound and/or a cationic heterocyclic imide such as an imidazolinium or pyridinium compound in a weight ratio of softener to peroxy bleaching agent of about 5:7 to 5:1.

15 Claims, No Drawings

LIQUID BLEACH-SOFTENER COMPOSITIONS

FIELD OF THE INVENTION

The invention relates to bleach, fabric-softener compositions and particularly to liquid bleach fabric softener compositions beneficially adapted for use in one or more of the wash, rinse and dryer cycles of an automatic laundry machine for imparting simultaneously, significant bleaching, softening and detergency effects to fabrics treated therewith.

BACKGROUND OF THE INVENTION

Description of the Prior Art

Conditioning compositions heretofore provided in the art for the treatment of fabrics in one or more cycles of an automatic laundering process usually include, with respect to bleaching and softening in particular, either a specific type of bleaching agent or softening agent. Combination of these materials in a unitary composition is at best vaguely suggested as regards specific types of ingredients, proportions and the like. Moreover, in such cases, it is indicated as being necessary to use the bleach material in solid form, and in substantial excess on a weight basis with respect to any softener compound which might be peripherally included within the relevant teaching. Peroxygen bleaches in such cases are usually limited to the normally solid, water-soluble types such as the alkali metal and ammonium perborates, percarbonate, mono-persulfates and mono-perphosphates, species of the foregoing including for example sodium and potassium perborates and percarbonates. The aforementioned normally solid, inorganic peroxygen bleaches are usually employed in combination with various types of solid activators such as those disclosed in U.S. Pat. No. 3,130,165.

Dispensing of the solid bleach composition in the appropriate cycle of the laundering process usually the dryer cycle, is often effected by means of a solid carrier material including various types of polymeric laminate and cellular structures, impregnated, coated, or otherwise treated with the conditioning composition.

U.S. Pat. Nos. relevant to the foregoing discussion include 3,945,936; 3,870,145; 3,944,694; 3,956,556; 3,634,947; 3,947,971 and 3,283,357. For the most part, the foregoing patents relate to the use of polyurethane-type carriers for the dispensing of either bleach or softener compositions in a given cycle, mainly the dryer cycle, of an automatic machine-laundering process.

The bleach component is usually added to the washing or drying cycle in solid form as described in U.S. Pat. No. 3,945,936 and British Patent Specification No. 1,456,592, the latter describing the coating of bleach granules with fatty alcohol for bleach rate and pH control in the washing medium. It is recognized that bleach compositions in liquid form (wash cycle) are currently available commercially; however, such compositions do not include, nor is provision made for the inclusion of, softener.

Softener compounds, on the other hand, are conventionally added to the laundering process suitably dispersed in a liquid carrier, which may in turn be incorporated, e.g., by impregnation, into a solid carrier support. Relevant in this regard are U.S. Pat. Nos. 3,442,692 and 3,632,396 describing the incorporation of liquid solutions or dispersions of softener e.g., quaternary ammonium compounds, into an absorbent sponge-type substrate and substrates of open pore structure from nonwoven cloth, paper, etc. of various shapes such as puffs, balls and the like. Other U.S. Pat. Nos. relevant to softener materials and structures for their dispensing in a laundering process include 3,870,145; 3,944,694; 3,956,556; 3,634,947 and 3,947,971.

Conditioning compositions in liquid form offer several advantages such as ready dissolution or dispersion in the washing media or on damp fabrics in the laundry dryer; homogeneit via solubilization of solid and/or liquid components in the conditioner solvent; facility of dispensing e.g., by simple pouring; enhanced accuracy of predetermined dosage amounts due to the increased volume of conditioner solution being handled by the user, etc., By way of contrast, the use of solid conditioning compositions entails significant disadvantages such as the rather elaborate and cumbersome structures required for their efficient dispensing in the machine, as typified by the wide variety of carrier substrates described in the prior are hereinbefore cited, as well as the difficulties inherent in the compounding of solid ingredients in the form of a coherent, homogeneous mass having adequate structural as well as chemical stability.

In addition, conditioning compositions thus far provided are capable of performing but a single function, e.g. bleaching or softening, requiring, therefore, the use of separate compositions during the washing-drying process according to a predetermined sequence of addition. The inconvenience to the user readily is apparent.

In accordance with the concept underlying the present invention, it was found, surprisingly, that bleach and softener compounds, subject to the requirements to be hereinafter discussed in detail, could be effectively combined in a single liquid composition to simultaneously provide effective bleaching, softening, detergency, antistat properties, etc. when added to one or more of the wash, rinse and dryer cycles of an automatic machine laundering process. The result is somewhat surprising since it would normally be expected that problems associated with, for example, compatibility and stability of the involved ingredient and particularly in a liquid environment normally considered to be highly conclusive to undesired, fugitive side reactions, would militate against any possible effectiveness. Thus, prior art attempts to combine softener and bleach in a single composition have stressed the requirement for solid rather than liquid vehicles and even then under relatively stringent limitations as regards mutual proportions of active ingredients, assuring for example, the presence of bleach in at least substantial excess over softener. Thus, the recognized tendency of many softeners to form insoluble gels when present together with a peroxy bleaching agent in an aqueous medium is a significant factor in the compounding of such compositions.

Thus, a primary object of the present invention is to provide a conditioning composition wherein the foregoing and related disadvantages are eliminated or at least mitigated to a substantial extent.

A further object of the invention is to provide a liquid, bleach fabric-softener composition capable of simultaneously and effectively bleaching and softening fabrics treatment therewith.

A still further object of the invention is to provide such a composition which may be added to one or more of the wash, rinse and dryer cycles of an automatic machine washing and drying operation.

Yet a still further object of the invention is to provide such a composition having good stability on aging at ambient and elevated temperatures over relatively prolonged periods of time.

Another object of the invention is to provide such a composition having good compatibility of ingredients under varying conditions of storage and use.

Still another object of the invention is to provide such a composition completely safe for use with fabrics of dyed, synthetic fibers such as Dacron, Dacron-cotton, permanent press as well as natural fibers.

Yet another object of the invention is to provide a process employing such composition in the conditioning of fabrics in a laundering process.

Other objects and advantages of the invention will become apparent hereinafter as the description proceeds.

DETAILED DESCRIPTION OF THE INVENTION

The attainment of the foregoing and related objects is made possible in accordance with the invention which in its broader aspects includes a liquid, bleach, fabric-softener composition advantageously adapted for use in one or more of the wash, rinse and tumble drying cycles of a laundering process consisting essentially of, by weight, from about 3 to 10% of water-soluble peroxy bleaching agent, at least about 50% thereof being hydrogen peroxide, and from about 3 to 25% of water soluble or dispersible fabric softener compound, at least about 50% thereof being cationic amine softener, the weight ratio of softener to peroxy bleach being from about 5:7 to 5:1, the balance of said composition being water or solution thereof with up to 10% of lower alkanol.

In a further aspect, the invention includes a process of conditioning fabrics by simultaneous bleaching and softening thereof comprising contacting said fabrics in one or more of the wash, rinse and tumble drying cycles of a laundering process with an effective bleaching and softening amount of the composition above described.

In accordance with the invention, at least about 50% and more preferably, at least about 75% of the peroxy bleaching agent is hydrogen peroxide. In the present invention, hydrogen peroxide is somewhat unique and atypical within the broad class of known peroxy bleaches, exhibiting a highly satisfactory level of stability when exposed to varying conditions of temperature despite the presence of the softener compound. Moreover, the bleaching activity of the hydrogen peroxide and thus its ability to remove oxidizable stains from treated fabrics is apparently wholly unaffected by the softener compounds despite thier prolonged periods of standing at elevated temperatures, e.g. up to about 130°-140° F. The stable condition obtains despite the recognized activity of hydrogen peroxide in aqueous media and especially in the presence of compounds capable of undergoing oxidation. Hydrogen peroxide is generally supplied commercially in the form of an aqueous solution, such as the 50% solution available on the market as Albone 50% CG. Other water soluble peroxygen bleaching agents useful herein in combination with the hydrogen peroxide i.e., auxiliary bleaching agents, include, without limitation, the inorganic peroxy compounds such as the alkali metal and ammonium perborates, percarbonates, monopersulfates and monoperphosphates in their various hydrated forms. Specific examples are sodium and potassium perborates, sodium and potassium percarbonates and the like. Other useful materials include the water soluble organic peroxy acids and/or the water soluble salts, e.g. alkali metal salts, thereof such as described in U.S. Pat. No. 3,749,673; the mixtures of organic peroxy acids and persulfate bleaches described in U.S. Pat. No. 3,773,673. Activators for one or more of the aforementioned bleaching materials may also be used in known manner such as described in U.S. Pat. Nos. 3,130,165 and 3,945,936.

As indicated, the amount of auxiliary bleaching agent is less than about 50% and preferably less than about 25% of the total bleach employed. It will further be understood that any such auxiliary bleach or amounts thereof having an adverse effect upon the composition in terms of stability, functionality, and the like are excluded as to such amounts and types. In any event, in accordance with the highly preferred embodiment of the invention, the bleach component is solely hydrogen peroxide.

The concentration of peroxy bleach in the composition is from about 3 to 10% by weight with a range of 4 to 8% being preferred, the value selected in a specific instance being such as to provide a softener: bleach weight ratio in the final composition of from about 5:7 to 5:1. Within the range given, the specific amount selected mainly has reference to the severity of the laundering problem contemplated for the product composition.

Softener compounds for use herein fall into the general category of cationic amines, this term intended to cover cationic imides as well. Thus, softeners of the aliphatic quaternary ammonium types as well as cyclic imides are included such as the imidazolinium and pyridinium salts. In general, the aliphatic quaternary ammonium softeners can be represented according to the following structural formula

A.

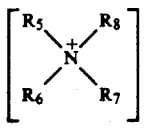

wherein $R_5$ is an aliphatic, eg. alkyl, group of from 12 to 22 carbon atoms; $R_6$ is an aliphatic eg. alkyl, group of from 1 to 22 carbon atoms and $R_7$ and $R_8$ are each lower alkyl groups of 1 to 4 and preferably 1 to 3 carbon atoms, and X is a water-soluble salt forming anion, such as a halide, i.e., chloride, bromide, iodide; a sulfate, a citate, hydroxide, methosulfate or similar inorganic or organic solubilizing mono-or dibasic radical. Examples of quaternary ammonium softeners useful herein include, without necessary limitation, hexadecyltrimethyl ammonium bromide, this being a particularly preferred species; hydrogenated ditallow dimethyl ammonium chloride; ethoxylated (n=3) distearyl methyl ammonium chloride; dihexadecyl dimethyl ammonium chloride; diotadecyl dimethyl ammonium chloride; dieicosyl dimethylammonium chloride; didocosyl dimethyl ammonium chloride; dihexadecyl diethyl ammonium chloride; dihexadecyl dimethyl ammonium acetate; ditallow dimethyl ammonium nitrate; etc.

Another and preferred class of cationic nitrogen softener for use herein are the imidazolinium salts which can be represented according to the following structural formula:

B.

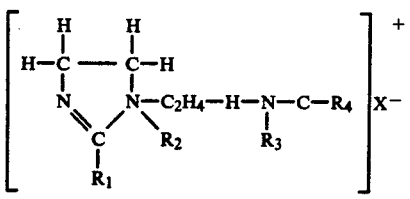

wherein $R_1$ is alkyl of from 8 to 25 carbon atoms; $R_2$ is alkyl of from 1 to 4 carbon atoms; $R_3$ is hydrogen or alkyl containing from 8 to 22 carbon atoms; $R_4$ is hydrogen or alkyl of from 1 to 4 carbon atoms and X is an anion having the aforedefined significance. Examples of compounds within the above formula are: 1-methyl-1-(tallowamidoethyl)-2-tallow imidazolinium methyl sulfate this being a particularly preferred species and available commercially as varisoft 475 softening agent and 2-heptadecyl-1, 1-methyl (2-stearoylamido) ethyl imidazolinium methyl sulfate. Compounds particularly preferred herein are those within the above formula wherein $R_1$ and $R_3$ are alkyls of from about 12 to 22 carbon atoms.

Another preferred class of softening agents for use herein are the alkyl ($C_{12}$ to $C_{22}$) pyridinium chlorides and alkyl ($C_{12}$ to $C_{22}$)-alkyl($C_1$ to $C_3$)-morpholinium chlorides. A particularly preferred species of this type of softener is cetyl pyridinium chloride (monohydrate).

The softener compound above described may be employed singly or in admixtures comprising tow or more thereof and in a total concentration of from about 3 to about 25% by weight of product composition. The value selected is such as to provide a softener: peroxy bleach weight ratio of from about 5:7 to 5:1 as previously indicated. The indicated amounts of softener and bleaching agent, as regards total concentration in the product composition are such as to provide effective softening and bleaching having reference to the wide disparity in the severity of the cleaning problems normally encountered with both synthetic type and natural fabrics.

It will be understood that the foregoing formulae are used to define preferred classes of softener and are not to be considered as limitative. Thus, in accordance with preferred practice, softeners comprising cationic nitrogen compounds of heterocycle structure, i.e., the cationic imides are generally useful herein. Those compounds within the formulae given are those generally found to assure optimum results in accordance with the objectives of the present invention.

The aforedescribed softeners constitute at least about 50% and preferably at least about 75% of the total softener used. In accordance with a highly preferred embodiment, such softeners comprise the sole softener component. Auxiliary softeners useful herein are well known in the art and may, in general, be selected from a relatively wide variety of materials. Examples include, without necessary limitation (a) the zwitterionic quaternary ammonium compounds such as 3-(N-elcosyl-N,N-dimethyllammonio)-2-hydroxypropane-1-sulfonate; 3-(N-eicosyl-N.N-dimethylammonio) propane-1-sulfonate; 3-(N-docosyl-N,N-dimethylammonio)-2-hydroxypropane-1-sulfonate; 3-(N-tetracisyl-N,N-dimethylammonio)-propane-1-sulfonate; 3-(N-hexacosyl-N,N-dimethylammonio)2-hydroxypropane-1-sulfonate and the like; (b) nonionic tertiary phosphine oxide such as eicosyldimethylphosphine oxide; docosyldi(2-hydroxyethyl phosphine oxide; hexacosyldimethylphosphine oxide; dicosyldiethylphosphine oxide; eicosylmethylethylphosphine oxide; tricosyldiethylphosphine oxide; pentacosyldimethylphosphine oxide; heptacosyldimethylphosphine oxide and the like; (c) nonionic tertiary amine oxides such as eicosyl-bis-(B-hydroxyethyl) amine oxide; docosyldimethylamine oxide; tetracosyldimethylamine oxide; 2-hydroxyeicosyldiethylamine oxide; tricosyldimethylamine oxide; tetracosyldiethylamine oxide and the like; (d) nonionic ethoxylated alcohol compounds generally comprising the reaction product of $C_{20}$–$C_{30}$ alcohols with from 3 to 45 molestheylene oxide; (e) ethoxylated alcohol sulfates comprising the sulfated condensation products of $C_{20}$–$C_{30}$ alcohols with 1–20 moles of ethylene oxide; (f) $C_8$–$C_{20}$ alkyl sulfate anionic synthetic detergents; (g) ampholytic synthetic detergents, softeners of the aforedescribed types being more fully described, for example, in U.S. Pat. No. 3,843,395. Again, softener materials or amounts thereof which materially, adversely affect the stability or functionality of the product composition are excluded herein as to such types and/or amounts.

Softener materials particularly preferred for use herein comprise the cationic nitrogen softeners of the heterocyclic imide type, the preferred materials within this class being the imidazolinium and pyridinium salts. It appears that these materials exhibit greater stability on standing and particularly at elevated temperatures when compared to softeners of the aliphatic quaternary ammonium type. This is confirmed by experimental evidence gained from aging tests conducted with representative species of each of the preferred classes of aliphatic quaternary ammonium, imidazolinium and pyridinium softeners.

Table I below summarizes the test results obtained upon aging, under the conditions specified, the following composition in accordance with the invention:

| Ingredient | % by weight |
|---|---|
| [1]Hydrogen peroxide (Albone 50% CG) | 12.0 |
| Hexadecyltrimethyl Ammonium bromide | 5.0 |
| Deionized water | 83.0 |
| | 100.0 |

[1]50% solution of hydrogenperoxide; $H_2O_2$ = 6% of composition pH adjusted with 25% $H_2SO_4$ to 4.2

The aging test results are as follows:

TABLE I

| (Initial HO Concentration = 6.0%) % H O remaining after: (days) | | |
|---|---|---|
| Temperature | 30 | 60 |
| RT | 6.0 | 5.4 |
| 100° F. | 3.8 | 2.4 |
| 120° F. | 3.7 | 2.4 |

The hexadecyltrimethyl ammonium bromide-$H_2O_2$ system exhibits reasonably good stability at room temperature; however, relatively severe loss in the $H_2O_2$ occurs at temperatures of 100° F. and 120° F. as the data indicates. Marked improvement in system stability is obtained when a suitable $H_2O_2$ stabilizer, such as ethylenediaminetetraacetic acid (EDTA), is added to the composition. In any event, for normal room temperature conditions of storage, the stability of the system appears to be reasonably adequate.

The following composition in accordance with the invention was similarly tested:

| Ingredient | % by weight |
|---|---|
| Hydrogen peroxide (Albone 50% CG) | 12.0 |
| Cetyl pyridinium Chloride (monohydrate) | 5.0 |
| Deionized water | 83.0 |
| | 100.0 |

pH adjusted with 25% $H_2SO_4$ to 4.5 with the following result:

TABLE 2

| (initial $H_2O_2$ concentration = 6.0%) % $H_2O_2$ remaining after: (days) | | | | |
|---|---|---|---|---|
| Temperature | 30 | 60 | 87 | 120 |
| RT | 6.0 | 5.9 | 5.9 | 5.9 |
| 100° F. | 5.9 | 5.7 | 5.7 | 5.7 |
| 120° F. | 5.8 | 5.7 | 5.7 | 5.7 |

Stability of the pyridinium chloride/$H_2O_2$ system is excellent at both room and elevated temperatures with about 95% of the $H_2O_2$ remaining after a period of about 4 months at the relatively severe storage temperature of 120° F.

The following composition in accordance with the invention was similarly tested:

| Ingredient | % by weight |
|---|---|
| Hydrogen peroxide (Albone 50% CG) | 12.0 |
| [1]Varisoft 475 | 6.7 |
| Deionized water | 81.3 |
| | 100.0 |

pH adjusted to 4.5 with 25% $H_2SO_4$
[1]1-methyl-1-(tallow amidoethyl)-2-tallow imidazolinium methyl sulfate; 75% AI = 5.0% softener with the following results:

TABLE 3

| (initial $H_2O_2$ concentration = 6%) % $H_2O_2$ remaining after: (days) | | | | |
|---|---|---|---|---|
| Temperature | 45 | 75 | 120 | 195 |
| RT | 6.0 | 6.0 | 6.0 | 5.6 |
| 100° F. | 6.0 | 6.0 | 5.9 | 5.2 |
| 120° F. | 5.9 | 5.8 | 5.8 | 5.0 |

Stability of the imidazolinium salt/$H_2O_2$ system is also excellent at both room and elevated temperatures with about 97% of the $H_2O_2$ remaining after a period of about 4 months at the high storage temperature of 120° F. Not until a period of about 6½ months had elapsed at temperatures of 100° and 120° F. was there any appreciable loss of $H_2O_2$.

Similar testing conducted with respect to the softener component gave comparable results, i.e., appreciable loss of softener, e.g. varisoft 475, did not occur until a period of 4 months had elapsed and then only at a temperature of 120° F. At a temperature of 120° F., about 90% of the softener remained after a period of 105 days. Even better results obtained at temperatures below 120° F.

Similar results are obtained when the above tested softeners are replaced wholly or in part by other of the primary softeners included by Formulae A & B and the pyridinium compounds hereinbefore given. Partial substitution of the primary softener and $H_2O_2$ with the auxiliary materials previously described tends to diminish the stability of the composition and particularly when such replacement is on the order of 50%. In such cases, the use of stabilizers such as the EDTA previously mentioned tends to promote stability.

Most desirably, the pH of the present liquid, bleach fabric softener compositions should be maintained on the acid side e.g., from about 4 to 5, with a range of 4.3 to 4.7 being particularly effective. The acid pH appears to assure not only good composition stability but bleach and softener effectiveness as well. In addition, more favorable effects as regards detergency and antistatic properties obtain at the acid pH. The acid pH assumes even greater importance in these regards as the concentration of the peroxy and softener compounds in the composition is increased within the limits hereinbefore given, i.e., $H_2O_2$ concentration of up to about 10% and softener concentrations of up to about 25%. The use of buffers and $H_2SO_4$, $NaO_4$ and the like is recommended should pH adjustment be necessary.

One of the truly surprising aspects of the present invention is that the softener component when used as described, in no way adversely affects the stain removal capacity of the peroxy bleaching agent and particularly the hydrogen peroxide. Testing indicates the bleach and softener compounds herein to be satisfactorily compatible under normal and even abnormal conditions of storage and use. When tested against commercial wash cycle bleaching compositions containing hydrogen peroxide in identical and greater amounts, the instant compositions are at least as effective as regards the removal of oxidizable stains from a variety of fabrics and particularly dyed fabrics of synthetic fibers, permanent press. In terms of softening effects, the present compositions are markedly superior. Moreover, these results obtain when comparative testing is carried out in the dryer as well as wash cycles of an automatic machine laundering operation. No fabric discoloration or other untoward effect can be observed indicating the present compositions to be completely safe with even the more problematical types of fabrics.

Similarly, the instant, compositions compare at least favorably when tested against commercial softener compositions on the basis of identical softener concentration. Again, the favorable results obtain when testing is carried out in the wash, rinse and dryer cycles of the laundering process.

For optimum results, it is usually recommended that the softener concentrations within the higher portion of the range hereinbefore given be used should the instant composition be intended fpr use in the dryer. For such application, it is advisable that the liquid bleach fabric softener composition be relatively quickly dispensed onto the damp fabrics, e.g., during the first 15 minutes of the normal 60 minute dryer cycle to assure uniform and effective stain removal. Higher softener concentration thus assures complete and uniform contacting with the fabrics. However, it should be understood that even at the lower softener concentration, the instant compositions compare well with the commercial formulae as the examples will make clear.

In some cases, slight gel formation may be observed in formulating the instant compositions with the use of higher levels (on the order of 25–50%) of auxiliary softener. This can be remedied for the most part by the use of small amounts of thinning agent such as NaCl, $NaNO_3$ and the like.

The present compositions can be introduced to the appropriate cycle(s) of the laundering process by a variety of means including simple pouring, the use of a substrate impregnated with the bleach-softener composition, a variety of container means provided with a plurality of perforations for metered release of the composition, e.g. perforated plastic bottle sich as polyethylene. One embodiment found to be particularly effective is the use of HANDIWIPE TM or other similar fabric substrate impregnated with an effective bleaching and softening amount of the instant composition. This embodiment is especially effective for use with damp fabrics in the laundry dryer. Alternatively, an appropriate amount of the bleach-softener composition can be added to a suitable perforated container, the perforations being covered by an adhesively bonded strip readily removable by the user at the time of use. The container can be provided with an adhesive backing enabling its ready attachment to the internal portion of the dryer, e.g., dryer door, the stationary unit, or a suction cup device appropriately positioned within the dryer. The substrate and container methods for product dispensing are particularly effective for product addition to the dryer. In any event, dispensing of product should be completed as a general rule within the first 15 minutes of the dryer cycle.

The total amount of bleach fabric softener composition added to the wash, rinse and or dryer cycles should in any event be effective to accomplish the desired level of stain removal and softening. The term "effective" amount as used herein is to be accorded its conventional and art-recognized significance in connoting an amount sufficient to soften and stain-clean the fabric being treated. It is appreciated that the severity of the stain removal problem, e.g., tea and wine stains, may necessitate the use of greater "effective" amounts. The term "effective" is to be interpreted having reference thereto. In any event for the vast majority of laundering applications, sufficient of the bleach-softener composition to provide a concentration in the wash medium of at least about 100 to 150 ppm is generally effective. When added to the dryer having a normal dryer load, sufficient of the bleach softener composition to provide about 2.5 to 3 g of softener and 0.7 to 1.1 g of peroxy bleach is found to be more than adequately effective. Thus, softener quantities as small as about 1.5 g per normal dryer load are found to provide appreciable softening and do not suffer significantly by comparison with currently available commercial brands of softener specifying the use of such quantities as to provide about 3 g of softener per normal dryer load.

The following examples are for purposes of illustration only and are not to interpret as necessarily constituting a limitation on the invention. All parts are by weight unless otherwise given. Detergent where used has the following composition:

Detergent A

10% Sodium linear tridecyl benzene sulfonate
2% C14-C15 fatty alcohol with an average of 11 ethylene oxide groups
2% mixed sodium coconut/tallow fatty acid soap
35% pentasodium tripolyphosphate
7% sodium silicate ($Na_2O$:SiO ratio 1:2.35)
6.5% sodium carboxy methyl cellulose
balance sodium sulfate Example 1 compares the stain removal and softening effects of a composition in accordance with the invention with a commercial bleach containing $H_2O_2$ when each is added in separate runs to the wash cycle of General Electric automatic washing machine equipped with temperature control means and automatic wash, rinse and spin dry cycles.

EXAMPLE 1

120 g (½ cup) of the following composition

| Ingredient | % | g/$H_2O_2$ | g/varisoft |
|---|---|---|---|
| $H_2O_2$ (50% Albone CG) | 12.0 | 7.2 | — |
| Varisoft 475 | 6.7 | — | 6.0 |
| Deionized water | 81.3 | — | — |
| | 100.0 | | |

(a) is added by following to the laundry machine containing test fabrics of Dacron-cotton (50:50), permanent press. About 1¼ cup of detergent A is added therewith. Washing is conducted as recommended by the manufacturer using tap water at 100° F. The test fabrics after completion of the wash rinse and spin dry cycles are dried in a tumble dryer for 1 hour at the normal setting.

(b) The above procedure is repeated but replacing the Varisoft bleach-softener composition with 120 g (½ cup) of a commercial wash cycle bleach containing 6% $H_2O_2$, the balance water to provide 7.2 g of $H_2O_2$ in the wash water. The $H_2O_2$ contents of the Varisoft and commercial bleach runs are thus identical.

Reflectance readings taken on the test fabrics before and after laundering (initial reflective readings being identical in each case for the comparative test run) by standard techniques gives the following results (Δ Rd)

| | Δ Rd | | |
|---|---|---|---|
| Composition | Tea | Grape | Wine |
| (a) | 1.9 | 30 | 31 |
| (b) | 2.3 | 31 | 31 |

The stain removal capacity of the Varisoft composition (a) for the same concentration of $H_2O_2$ is essentially equal to commercial bleach run (b). Softness ratings taken on the test fabric by 5 independent panelists establish the Varisoft composition to have markedly superior softness to the composition of run (b).

EXAMPLE 2

Example 1 (a) and (b) is repeated except that the Varisoft composition is inpregnated into a HANDIWIPE TM specimen and then added to the washing machine. The bleaching and stain removal results are essentially the same as those of Example 1.

EXAMPLES 3 & 4

Examples 1 and 2 are repeated except that the concentration of Varisoft is increased to 16% to provide a softener bleach ratio of about 14.4:7.2 or 2:1. The bleach and softener results are essentially similar to those of Examples 1 and 2, the Varisoft composition providing a yet greater measure of softness.

EXAMPLE 5

(a) Example 1(a) is repeated except that the Varisoft composition in the amount of 60 g (¼ cup) is added to the machine immediately upon commencement of the rinse cycle to provide 3.6 g and 3.0 g of $H_2O_2$ and softener, respectively, (b) part (a) is repeated except that the Varisoft composition is replaced by an equivalent amount of a wash cycle commercial softener composition containing the same amount of softener used in part (a). In addition, 1¼ cup of detergent is added in this run.

Stain removal and softness data are taken as in Example 1 with the following results.

| | Δ Rd | | |
|---|---|---|---|
| Composition | Tea | Grape | Wine |
| (a) | 1.2 | 32 | 31 |
| (b) | 1.3 | 27 | 27 |

The Varisoft composition is markedly superior in terms of stain removal; a measure of superiority might be expected since the commercial softener does not contain bleach. However, the commercial softener is augmented with detergent as indicated. Nevertheless, stain removal is clearly inferior to the Varisoft run. Even more striking is the fact that softness ratings taken on the test samples by 5 independent panelists indicated the Varisoft composition to be at least equal and in some cases superior to the commercial softener product in terms of softeness.

EXAMPLE 6

Example 5 is repeated except that the Varisoft composition impregnated into a HANDIWIPE TM specimen and then added to the rinse cycle. The bleach and softening results are essentially similar to those of Example 5.

EXAMPLE 7

Example 6 is repeated except that the Varisoft composition, impregnated into a HANDIWIPE TM specimen in the amount of 30 g (⅛ cup), is added to the damp test fabrics (normal dryer load) in a laundry dryer to provide 1.8 g $H_2O_2$ and 1.5 g softener.

In a separate run (b) an equivalent amount of the commercial softener composition (1.5 g) is added directly to the damp test fabrics in the laundry along with 1¼ of detergent A. Drying is carried out at the normal setting, in accordance with the manufacturer's specifications, for 1 hour.

Stain removal and softness data are taken as previously described with the following results.

| | Δ Rd | | |
|---|---|---|---|
| Composition | Tea | Grape | Wine |
| (a) | 10 | 41 | 40 |
| (b) | 1.3 | 27 | 27 |

Again, the difference is stain removal is pronounced in favor of the Varisoft composition despite the use of significant amounts of detergent in the commercial softener run, which would ordinarily be expected to significantly boost the detergency and thus stain removal ability of the commercial softener.

As indicated by the results of Examples 1-7, the instant bleach-softener compositions are capable of providing at least equal softness and stain removal in all cycles of the laundering process when compared to separately provided commercial softener and bleach compositions. These results obtain whether dispensing of the instant product be by simple pouring (as is necessarily the case with the commercial compositions) or by means of an impregnated substrate as typified by the HANDIWIPE TM article.

When the various procedures of Example 1-7 are repeated but replacing the Varisoft 475 with equivalent amount of (a) hexadecyltrimethyl ammonium bromide and (b) cetyl pyridinium chloride (monohydrate), essentially the same results are obtained i.e., oxidizable stain removal and softness results compare at least equally with the commercial compositions separately provided for such purposes. In most cases, the cetyl pyridinium chloride compositions, representatives of the cationic cyclic imides for use herein, are superior to the hexadecyltrimethyl ammonium bromide, the latter representative of the aliphatic, cationic quats herein described, with respect to both stain removal and softness. However, the aliphatic softener in any event compares favorably with the commercial bleach and softener compositions in softness and stain removal results.

EXAMPLE 8

The procedure of Example 1 is repeated but using a wash temperature of 120° F. The test fabrics in each case comprise Dacron-cotton (50:50) permanent press stained with grape juice, bluberry pie filling and tea respectively. The compositions tested are as follows:

(a) Varisoft composition of Example 1

(b) Commercial bleach composition containing 6% of $H_2O_2$ (7.2 g)

(c) Detergent A above (0.15% in wash medium)

Reflective softness ratings are taken on the laundered fabric samples as described

| | Rd | | |
|---|---|---|---|
| Composition | Tea | Grape | Blueberry Pie Filling |
| (a) | 13.0 | 63.6 | 67.2 |
| (b) | 8.5 | 62.9 | 65.0 |
| (c) | 4.9 | 62.6 | 62.4 |

Each of the Varisoft and commercial bleach compositions (a) and (b) is superior to the use of detergent alone (c). More striking here is the marked superiority of the Varisoft composition over the commercial formula in all categories and particularly with respect to tea stain. In Example 1 wherein washing is carried out at 100° F., composition (b) is slightly superior regarding tea stain with essential parity obtaining for grape and wine stain. The overall superiority of the instant compositions appears to become increasingly manifest at the higher washing temperature and particularly as regards normally difficult tea stain.

In the present example, the Varisoft composition (a) is definitely superior to the commercial bleach (b) and detergent (c) compositions as to softness, this being concluded by an independent panel of testers. Composition (a) is likewise essentially equal to a commercial wash cycle softener added in a separate run to the wash cycle and having the same amount of softener as in composition (a).

EXAMPLES 9 & 10

Example 8 is repeated but wholly replacing the Varisoft with (a) hexamethyltrimethyl ammonium bromide and (b) cetyl pyridinium chloride respectively. The softness and stain removal results are essentially similar to those of Example 8, superiority over the commercial bleach and detergent formula being conclusively indicated from the data. Again, the cetyl pyridinium chloride composition is superior to the hexadecyltrimethylammonium bromide in both stain removal and softness.

EXAMPLE 11

Example 8 is repeated except that each of the Varisoft, commercial bleach and commercial softener composition is added by pouring on to the damp test fabrics in the laundry dryer. The test run using detergent alone is omitted. Drying is carried out in a machine dryer for about 1 hour at 160°-170° F.

Reflectance and softness ratings are taken as previously described with the following results:

| | Δ Rd | | |
|---|---|---|---|
| Composition | Tea | Grape | Blueberry Pie |
| (a) | 18.8 | 66.7 | 69.6 |
| (b) | 18.4 | 66.2 | 69.3 |
| [1](c) | 6.4 | 61.6 | 61.2 |

[1]commercial softener composition having same amount of softener as in (a) = 6.0g.

The Varisoft composition is slightly superior to the commercial bleach run in all aspects tested, each of these compositions being markedly superior to commercial softener (c). In terms of softness, (a) is about equal to (c) each of which is noticeably superior to (b).

EXAMPLES 12 & 13

Example 11 is repeated but wholly replacing the Varisoft with (a) hexadecyl trimethyl ammonium bromide and (b) cetyl pyridinium chloride. Similar stain removal and softness results are obtained. Again, the cetyl pyridinium chloride is somewhat superior to the hexadecyltrimethyl ammonium bromide in stain removal and softness results.

EXAMPLE 14

The procedure of Example 11 is repeated. In this case however, the compositions tested are as follows:

(a) 30 g of the Varisoft composition of Example 1 to provide 1.8 g $H_2O_2$ and 1.5 g softener with the damp test fabrics in the laundry dryer.

(b) commercial softener to provide 3.0 g softener with the damp test fabrics in the laundry dryer.

Reflective and softness readings are taken as previously described with the following results:

| | ΔRd | | |
|---|---|---|---|
| Composition | Tea | Grape | Wine |
| (a) | 12 | 46 | 34 |
| (b) | 2.7 | 40 | 27 |

Superior stain removal is clearly evident for the Varisoft composition. The overall stain removal effectiveness of the Varisoft composition is made more manifest by reference to the fact that the amount of bleach ($H_2O_2$) used is but one-quarter (1.8 vs. 7.2 g) that of Example 11. In terms of softness, the commercial composition (b) is slightly superior; however, the margin of superiority is much less than what would be expected in view of the fact that only 1.5 g Varisoft are used as compared to 3.0 g softener from the commercial product (b).

EXAMPLE 15

Example 14 is repeated except that the amount of Varisoft composition (a) used in increased to 60 g thereby providing 3.6 g $H_2O_2$ and 3.0 g softener with the damp test fabrics in the laundry dryer. Run (b) is identical with run (b) of Example 14.

Reflectance and softness readings are taken as described with the following results:

| | Rd | | |
|---|---|---|---|
| Composition | Tea | Grape | Wine |
| (a) | 14 | 46 | 34 |
| (b) | 2.7 | 40 | 27 |

Stain removal is about the same as for Example 14 with a significant increase in tea stain removal for (a) being a notable exception. In this example, the softness of test fabrics treated with the Varisoft composition is at least equal to that of the commercial softener (b), each of these compositions containing 3.0 g softener.

Similar results are obtained when the Varisoft in the preceding examples is wholly replaced in equivalent amounts with (a) hexadecyltrimethylammonium bromide and (b) cetyl pyridinium chloride, the latter proving somewhat superior to the former. in both stain removal and softness.

EXAMPLE 16

The procedure of Examples 14 and 15 is repeated with respect to the following compositions.

(a) same as (a) in Example 14=1.8 g $H_2O_2$ & 1.5 g softener (b) same as (a) in Example 15=3.6 g $H_2O_2$ & 3.0 g softener (c) 70 g of (a) in Example 15=4.2 g $H_2O_2$ & 3.5 g softener (d) 30 g of the following composition:

| Ingredient | % | g/$H_2O_2$ | g/Varisoft |
|---|---|---|---|
| Deionized water | 74.7 | — | — |
| Varisoft 475 | 13.3 | — | 10 |
| $H_2O_2$(Albone 50% CG) | 12.0 | 6.0 | — |
| | 100.0 | | |

to provide 1.8 g $H_2O_2$ and 3.0 g softener.

(e) commercial wash cycle bleach composition 120 g added to the wash cycle with about 1¼ cup of detergent A to provide 7.2 g $H_2O_2$.

Reflectance readings taken on the test fabrics in the manner described yield the following results:

| | Rd | | |
|---|---|---|---|
| Composition | Tea | Grape | Wine |
| (a) | 12 | 46 | 34 |
| (b) | 14 | 46 | 34 |
| (c) | 14 | 46 | 34 |
| (d) | 12 | 45 | 34 |
| (e) | 5 | 37 | 30 |

Use of the instant bleach softener compositions in the laundry dryer is in all aspects significantly superior to the use of the commercial bleach composition (e) in the wash cycle in the manner prescribed by the manufacturer. The vast improvement is obtained despite the use of significantly less $H_2O_2$ in the instant composition as compared to the commercial bleach. Thus, compositions (a) and (d) which contain but one-quarter the amount of the $H_2O_2$ of commercial bleach (e) nevertheless provide markedly superior stain removal and particularly with respect to tea stain. Runs (b), (c) and (d) are at least equal in softness to a test run using 3.0 g commercial softener in the dryer; run (a) is but slightly inferior to the commercial softener run as to softness despite the use of but one-half the softener amount.

EXAMPLE 17

Example 16 is repeated except that compositions (a),(b), (c) and (d) are dispensed in the clothes dryer by means of a polyethylene bottle container provided with a plurality of perforations for release of bleach-softener composition. The perforations are sealed by means of an externally applied sealing strip of masking tape adhesively and removably bonded to the bottle. The sealing strip is peeled off at the time the drying cycle is begun. The bottle is secured to the inner stationary vent of the dryer by a bonding adhesive provided on the container enabling ready removal and refilling of the container upon completion of the drying cycle. The container is designed such that the entire charge of bleach-softener composition is dispensed onto the fabrics during the initial 15 minutes of the drying cycle.

The stain removal and softness results are essentially similar to those of Example 16.

The instant bleach softener compositions compare quite well with the more conventional chlorine type cleaches in terms of oxidizable stain removal. In terms of safety to colored synthetic fabrics, the present compositions are quite superior.

EXAMPLE 18

The procedure of Example 1 is repeated except that the $H_2O_2$ bleach of run (b) is wholly replaced with an equivalent amount of a commercial chlorine bleach. Reflectance measurements are taken as described with the following results:

| | Rd | | |
|---|---|---|---|
| Composition | Tea | Grape | Wine |
| (a) | 3.6 | 33 | 31 |
| (b) | 6 | 34 | 34 |

The instant compositions as typified by the Vasisoft composition itemized in Example 1, compare quite well with the commercial chlorine bleach and particularly with respect to grape and wine stain. Comparative runs testing the commercial (a) $H_2O_2$ bleach and (b) softener composition against the chlorine bleach of Example 18 indicated the instant compositions to be superior to the commercial formulae.

As indicated in the foregoing examples, the improvements made possible by the present invention are particularly manifest when the bleach, fabric softener composition is added to the dryer over a wide concentration range. Optimum results as to the dryer-added embodiment obtain, however, when the amount of softener in the composition is increased so as to provide a softener bleach ratio of up to about 5:1. A particularly effective composition for such use had the following composition:

| | % | g/$H_2O_2$ | g/Varisoft 475 |
|---|---|---|---|
| $H_2O_2$ (Albone 50% CG) | 12 | 6 | — |
| Varisoft 475 | 27 | — | 20 |
| Deionized water | 61 | — | — |
| | 100 | | |

the ratio of softener to H O being about 3.3. Above a softener bleach ratio of about 5, correlative increase in softening for increased softener concentration appears to be negligible. In contrast, it is found that excess of peroxy bleach above about 40% with respect to softener leads to destabilizing effects adversely affecting the softening and stain removal capabilities of the bleach-softener composition.

The bleach and softener components herein defined can be solubilized with water, preferably deionized, to reduce the possibility of contamination and degradation effects caused by impurities, or a mixture of water with up to about 10% of water soluble, lower $C_1$–$C_4$ alkanol such as propanol and/or isopropanol, the latter being preferred. The use of alcoholic solvents is especially preferred when using softener concentrations within the higher portion of the range given.

As indicated previously, in accordance with a particularly preferred embodiment of the invention, the softener component comprises a cationic, heterocyclic imide such as typified by the illustrated Varisoft. Accordingly, it is particularly preferred that at least about 50% and preferably 75% of the softener component be the cationic cyclic imide material.

Although the examples have been illustrated with respect to certain preferred embodiments of the invention, it will be understood that the invention is not limited thereto. Thus, similar results are obtained when the exemplified cetyl pyredinium chloride, hexadecyltrimethyl ammonium bromide and 1-methyl-1-(tallowamido-ethyl)-2-tallow imidazolinium methyl sulfate are replaced with one or more of the cationic amine softener compounds given hereinbefore and within the concentration limits defined. However, as previously stated, non-cationic amine softener, i.e. auxiliary softener, is to be used as a partial replacement only within the limitations previously expressed.

What is claimed is:

1. A liquid bleach, fabric-softener composition beneficially adapted for use in one or more of the wash, rinse and tumble drying cycles of a fabric-laundering process consisting essentially of, by weight, from about 3 to 10% of water soluble peroxy bleaching agent, at least about 50% thereof being hydrogen peroxide and from about 3 to 25% of water soluble fabric softener compound, at least about 50% thereof being cationic amine softener, the weight ratio of softener to peroxy bleach being from about 5:7 to 5:1, the balance of said composition being water or a mixture of water with up to about 10% of water soluble lower alkanol.

2. A composition according to claim 1 wherein said bleaching agent consists entirely of hydrogen peroxide.

3. A composition according to claim 2 wherein said softener consists entirely of cationic amine softener agent.

4. A composition according to claim 3 wherein said softener is cetyl pyridinium chloride.

5. A composition according to claim 3 wherein said softener is hexadecyltrimethyl-ammonium bromide.

6. A composition according to claim 3 wherein said softener is 1-methyl-1-(tallowamidoethyl)-2-tallow imidazolinium chloride.

7. A composition according to claim 1 wherein said softener comprises a cationic, heterocyclic imide.

8. A composition according to claim 1 wherein said softener is an imidazolinium compound of the formula:

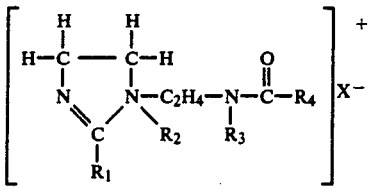

wherein $R_1$ is alkyl of from 8 to 25 carbon atoms; $R_2$ is alkyl of from 1 to 4 carbon atoms; $R_3$ is hydrogen or alkyl containing from 8 to 22 carbon atoms; $R_4$ is hydrogen or alkyl of from 1 to 4 carbon and X is an anion.

9. A composition according to claim 1 wherein said softener is an aliphatic quaternary ammonium compound of the formula:

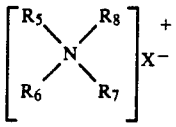

wherein $R_5$ is an aliphatic group of from 12 to 22 carbon atoms; $R_6$ is an aliphatic group of from 1 to 22 carbon atoms and $R_7$ and $R_8$ are each alkyl groups of from 1 to 4 carbon atoms.

10. A composition according to claim 1 wherein said softener is a $C_{12}$–$C_{22}$ alkyl pyridinium chloride.

11. A composition according to claim 1 having a pH of from about 4 to 5.

12. A composition according to claim 1 containing up to 50% of a softener selected from the group consisting of 2 zwitterionic quaternary ammonium compounds; nonionic tertiary phosphine oxides; nonionic tertiary amine oxides; nonionic ethoxylated alcohol compounds; ethoxylated alcohol sulfates; $C_8$–$C_{20}$ alkyl sulfate anionic synthetic detergents and ampholytic synthetic detergents.

13. A composition according to claim 1 containing up to 50% of a peroxy bleach compound selected from the group consisting of alkali metal and ammonium perborates, percarbonate, monopersulfates and monoperphosphates.

14. A composition according to claim 1 containing up to 10% isopropanol.

15. A process for simultaneously bleaching and softening fabrics being laundered comprising contacting said fabrics in one or more of the wash, rinse and tumble drying cycles of the laundering process with an effective bleaching and softening amount of the composition of claim 1.

* * * * *